United States Patent [19]

Le Helloco

[11] 4,174,144

[45] Nov. 13, 1979

[54] HOUSING FOR AN ELECTRICAL TERMINAL

[75] Inventor: Roger Le Helloco, Herblay, France

[73] Assignee: AMP Incorporated, Harrisburg, Pa.

[21] Appl. No.: 875,370

[22] Filed: Feb. 6, 1978

Related U.S. Application Data

[63] Continuation of Ser. No. 769,986, Feb. 18, 1977, abandoned.

[51] Int. Cl.[2] ..... H01R 11/02

[52] U.S. Cl. ..... 339/59 R; 339/256 SP; 339/258 S

[58] Field of Search ..... 339/59 R, 59 M, 256 SP, 339/258 S

[56] References Cited

U.S. PATENT DOCUMENTS

| | | | |
|---|---|---|---|
| 2,682,038 | 6/1954 | Johnson | 339/258 S |
| 3,641,477 | 2/1972 | Plana | 339/59 R |
| 3,781,760 | 12/1973 | Mancini et al. | 339/59 M |
| 4,050,757 | 9/1977 | Glaesel | 339/59 R |

FOREIGN PATENT DOCUMENTS

| | | | |
|---|---|---|---|
| 2032995 | 1/1972 | Fed. Rep. of Germany | 339/59 R |
| 1364450 | 8/1974 | United Kingdom | 339/59 R |

*Primary Examiner*—Gerald A. Dost

*Attorney, Agent, or Firm*—Allan B. Osborne

[57] ABSTRACT

An electrically insulating material housing for an electrical terminal comprising a receptacle portion for receiving a flat tab and a crimping ferrule portion axially aligned with the receptacle portion, the receptacle portion having a substantially flat base from the edges of which extend a pair of inwardly rolled over arms having their free ends directed towards the base such that the tab can be received and gripped between the free ends of the arms and the base, the housing being in the form of a tube having a pair of spaced parallel side walls joined by a bottom wall, and a top wall which slopes inwardly from each side wall of the housing towards the center of the top wall, the top wall carrying a stop projecting into the housing and arranged to engage behind the rolled over arms of a terminal when inserted into the housing from one end, and there being an inwardly directed stop at the other end of the housing whereby an inserted terminal is secured within the housing by engagement with the stops.

1 Claim, 6 Drawing Figures

HOUSING FOR AN ELECTRICAL TERMINAL

This is a continuation, of application Ser. No. 769,986, filed Feb. 18, 1977, now abandoned.

This invention relates to electrically insulating material housing for an electrical terminal.

A housing is known, which is moulded from synthetic plastics material in the form of a rectangular corss-section tube to receive and retain a terminal for mating with a flat tab inserted into the terminal through one end of the housing. The terminal comprises a receptacle portion for receiving the tab and a crimping ferrule portion which is axially aligned with the receptacle portion and which is crimped about the conductive core and insulation of an insulated wire prior to insertion of the terminal into the housing. The receptacle portion comprises a substantially flat base from the edges of which extend a pair of inwardly rolled over arms having their free ends directed towards the base such that the tab can be received and gripped between the free ends of the arms of the receptacle portion and the base, in known manner.

The known housing has a bottom wall with a substantially flat inner surface having a pair of spaced, axially extending ribs thereon, along which ribs the base of the terminal rides as the terminal is inserted into the housing, the base of the terminal remaining resting on the ribs when the terminal is in its final position retained in the housing.

The terminal is retained in the housing by means of stops formed at one end of the housing, up to which stops the terminal can be inserted from the other end of the housing, and a further stop intermediate the ends of the housing and on the inner surface of the wall opposite the base wall of the housing, which further stop extends substantially the width of the housing, and engages behind the rolled over arms of the terminal when the terminal is fully inserted into the housing, thus preventing withdrawal of the terminal from the housing in the direction opposite to the insertion direction.

In view of the method of securing the terminal in the housing, and the construction of the housing, which renders the housing relatively rigid, it is essential that the terminal have dimensions, and particularly a height dimension, within a relatively narrow range, since otherwise either the terminal will not be insertable into the housing, or at least sufficiently easily, or the terminal will not be secured in the housing by the stops, when inserted into the housing.

However, terminals within relatively wide dimension ranges are in use, and there is a need for a housing which can be used with many different size terminals.

According to this invention there is provided an electrically insulating material housing for an electrical terminal comprising a receptacle portion for receiving a flat tab and a crimping ferrule portion axially aligned with the receptacle portion, the receptacle portion having a substantially flat base from the edges of which extend a pair of inwardly rolled over arms having their free ends directed towards the base such that the tab can be received and gripped between the free ends of the arms and the base, the housing being in the form of a tube having a pair of spaced parallel side walls joined by top and bottom walls, the top wall carrying a stop projecting into the housing and arranged to engage behind the rolled over arms of a terminal when inserted into the housing from one end, and there being an inwardly directed stop at the other end of the housing whereby an inserted terminal is secured with the housing by engagement with the stops, characterised in that the top wall of the housing slopes inwardly from each side wall of the housing towards the centre of the top wall, the stop on the top wall being in two laterally spaced parts.

The housing of this invention has the advantages that it is relatively resilient, particularly in the height direction, and will thus easily receive and effectively retain terminals within a relatively wide range of dimensions, and particularly heights.

Preferably, the bottom wall of the housing beneath the receptacle portion of a terminal when inserted into the housing slopes outwardly from each side wall of the housing towards the centre of the bottom wall whereby the base of the receptacle portion of an inserted terminal engages the bottom wall of the housing substantially only along the lateral edges of the base of the receptacle portion of the terminal.

Preferably there is an inwardly directed rib extending axially along the centre of the top wall of the housing from said other end of the housing, which rib is received between the rolled over arms of a terminal inserted into the housing, and serves to ensure insertion of a terminal into the housing in the correct orientation.

This invention will now be described by way of example with reference to the drawings, in which.

Figure 1:
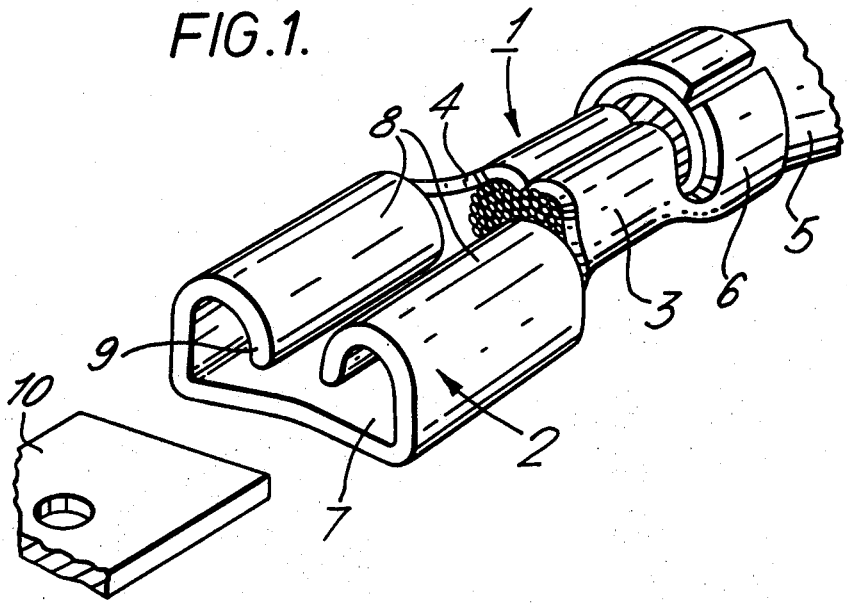
FIG. 1 is a perspective view of a terminal for reception in a housing according to this invention, together with a flat tab for mating with the terminal.

FIG. 1 shows an electrical receptacle terminal 1 stamped and formed from sheet metal, and comprising a receptacle portion 2, a first crimping ferrule 3 crimped about the conductive core 4 of an insulated wire 5, and a second crimping ferrule 6 crimped about the insulation of the wire 5, all in known manner.

The receptacle portion 2 comprises a substantially flat base 7 having a pair of inwardly rolled over arms 8 extending from the edges thereof, the free ends 9 of the arms 8 being directed towards the base 7 such that an electrical tab terminal 10 can be received and crimped between the free ends 9 and the base 7, in known manner.

Figure 6:
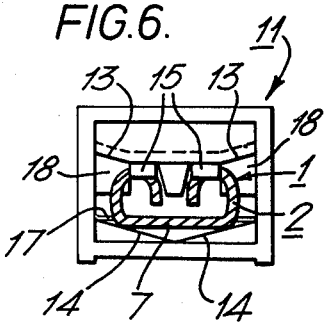
FIG. 6 is a view similar to FIG. 2 but showing; in cross-section, a terminal received in the housing.

Referring now to FIGS. 2 to 6, the housing 11 here shown in moulded from electrically insulating plastics material, and is in the form of a tube having a pair of spaced parallel side walls 12 joined by top and bottom walls 13 and 14. The top wall 13 carries a pair of stops 15 which project into the housing 11 and which are arranged to engage behind the arms 8 of a terminal 1 when inserted into the housing 11 from the end shown in FIGS. 2 and 6. Each stop 15 has a sloping surface 16 which rides over an arm 8 as the terminal 1 is inserted, until the stops 15 snap back behind the arms 8 as shown in FIG. 6. At the other end of the housing 11, shown in FIG. 5, there is an inwardly directed stop 17 upstanding from the bottom wall 14, and a pair of inwardly directed stops 18 depending from the top wall 13, one adjacent each side wall 12, which stops 17 and 18 together serve to prevent the terminal 1 from leaving the housing 11 from the other end (FIG. 5) thereof, as shown in FIG. 6, and also to guide a tab (10 in FIG. 1) into the receptacle portion 2 of a terminal 1 in the housing 11 in the correct manner.

An inwardly directed rib 19 extends axially along the centre line of the top wall 13 of the housing 11 from the end with the stops 17 and 18, which rib 19 is received between the arms 8 of an inserted terminal 1, as shown in FIG. 6, and thus serves to ensure insertion of the terminal 1 into the housing 11 in the correct orientation, incorrect insertion being prevented by engagement of the base 7 of the terminal with the rib 19.

Figure 2:
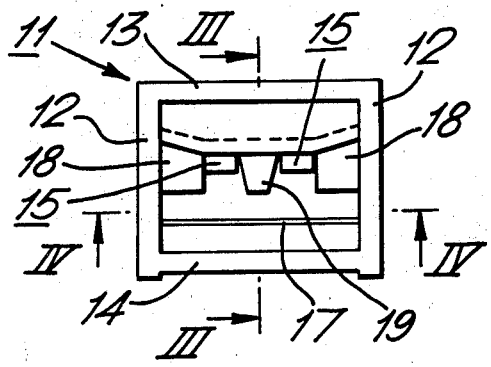
FIG. 2 is an end view of a housing according to this invention in the direction of the arrow II in FIG. 3.
Figure 3:
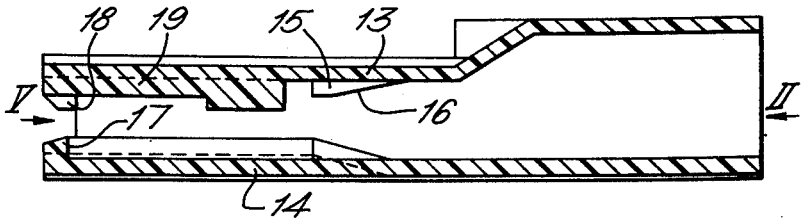
FIG. 3 is a section on the line III—III in FIG. 2.
Figure 4:
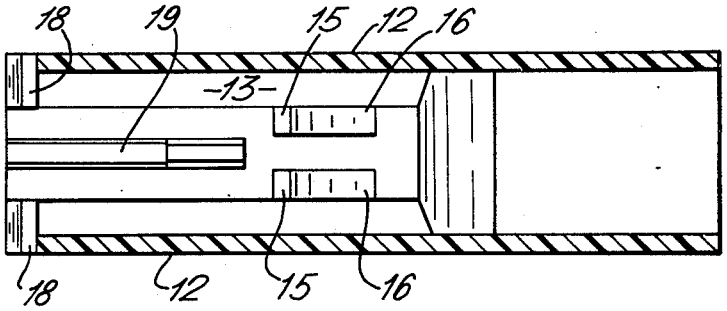
FIG. 4 is a section on the line IV—IV in FIG. 2.
Figure 5:
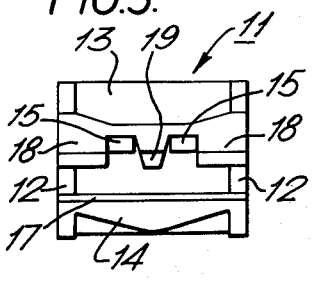
FIG. 5 is a view in the direction of the arrow V in FIG. 3.

As clearly shown in FIGS. 2 and 6, the top wall 13 of the housing 11 slopes inwardly from each side wall 12 of the housing 11 towards the centre of the top wall 13, that is towards the rib 19.

Further, as clearly shown in FIGS. 2 and 6, the bottom wall 14 of the housing 11 beneath the receptacle portion 2 of an inserted terminal 1, slopes outwardly from each side wall 12 of the housing 11 towards the centre of the base wall 14. Thus, the base 7 of the receptacle portion 2 of an inserted terminal 1 engages the bottom wall 14 of the housing only along the lateral edges of the base 7 of the receptacle portion 2 of the terminal 1, as shown in FIG. 6.

In view of the construction of the housing 11 described above, and particularly of the top and bottom walls 13 and 14 thereof, and the provision of two spaced stops 15 on the top wall 13, the housing 11 is relatively resilient, particularly in the height direction, and this together with the manner in which the base 7 of the receptacle portion 2 of an inserted terminal 1 engages the bottom wall 14 of the housing 11, enables the housing 11 to receive and satisfactorily retain by means of the stops 15, 17 and 18, terminals within a wider range of sizes, and particularly heights, than known housing, for example as described above.

What is claimed is:

1. A housing of resilient, non-conductive material for receiving varying sizes of electrical terminals comprising, a pair of spaced, parallel side walls joined by resilient top and bottom walls to define a passage through the housing, said top and bottom walls sloping in from either side wall towards the housing's center line in a generally V-shape, so that upon inserting an electrical terminal having a greater dimension than the passage, the passage may expand by the two generally V-shaped, top and bottom walls tending to straighten out.

* * * * *